United States Patent [19]

Meglino et al.

[11] Patent Number: 5,056,761

[45] Date of Patent: Oct. 15, 1991

[54] SLAT-RETAINING MEANS FOR CHAIN LINK FENCES

[76] Inventors: Don Meglino; James V. Meglino, both of 100 Frank Rd., Hicksville, N.Y. 11801

[21] Appl. No.: 637,608

[22] Filed: Jan. 4, 1991

[51] Int. Cl.[5] ..... B21F 27/00

[52] U.S. Cl. ..... 256/34; 256/35; 256/32

[58] Field of Search ..... 245/11; 256/34, 32, 256/35

[56] References Cited

U.S. PATENT DOCUMENTS

| | | | |
|---|---|---|---|
| 2,760,759 | 8/1956 | Rice | 256/34 |
| 3,285,577 | 11/1966 | Pinson | 256/34 |
| 4,512,556 | 4/1985 | Meglino | 256/34 |

*Primary Examiner*—Andrew V. Kundrat

[57] ABSTRACT

Plastic slats interwoven for privacy and wind protection in the wire mesh body of a chain link fence that are angled at 45 degrees and held against inadvertent removal by either slats or a ribbon inserted horizontally, rather than at a crossing 45 degree angle according to prior art practice, so that the user has the option of using only one horizontal holding slat or ribbon means.

3 Claims, 3 Drawing Sheets

SLAT-RETAINING MEANS FOR CHAIN LINK FENCES

The present invention relates generally to improvements for chain link fences in which, for privacy and wind protection, slats are interwoven in the wire mesh of these fences, and retaining means are provided to hold these slats in place, one such example of a chain link fence with vertically oriented retained interwoven slats being that described and illustrated in my prior patent U.S. Pat. No. 4,512,556 issued on Apr. 23, 1985.

EXAMPLE OF THE PRIOR ART

As an alternative to interwoven slats that are vertically oriented, as in my noted prior patent, it is already well known to use slats, again for privacy and wind protection, that are 45 degree diagonally oriented, as described and illustrated in U.S. Pat. No. 3,285,577 issued to A. Z. Pinson on Nov. 15, 1966. The slat retaining means, however, are slats or strips also diagonally oriented, thus requiring a significant number thereof at spaced intervals.

In accordance with the present invention, the wire mesh body of a chain link fence is interwoven with the diagonal slats of Pinson and effectively retained nevertheless with a nominal requirement of slat-retaining means as used, for example, in my noted prior patent or other known vertical slat arrays, thus having the advantages of a diagonal slat pattern and nominal installation effort and time.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
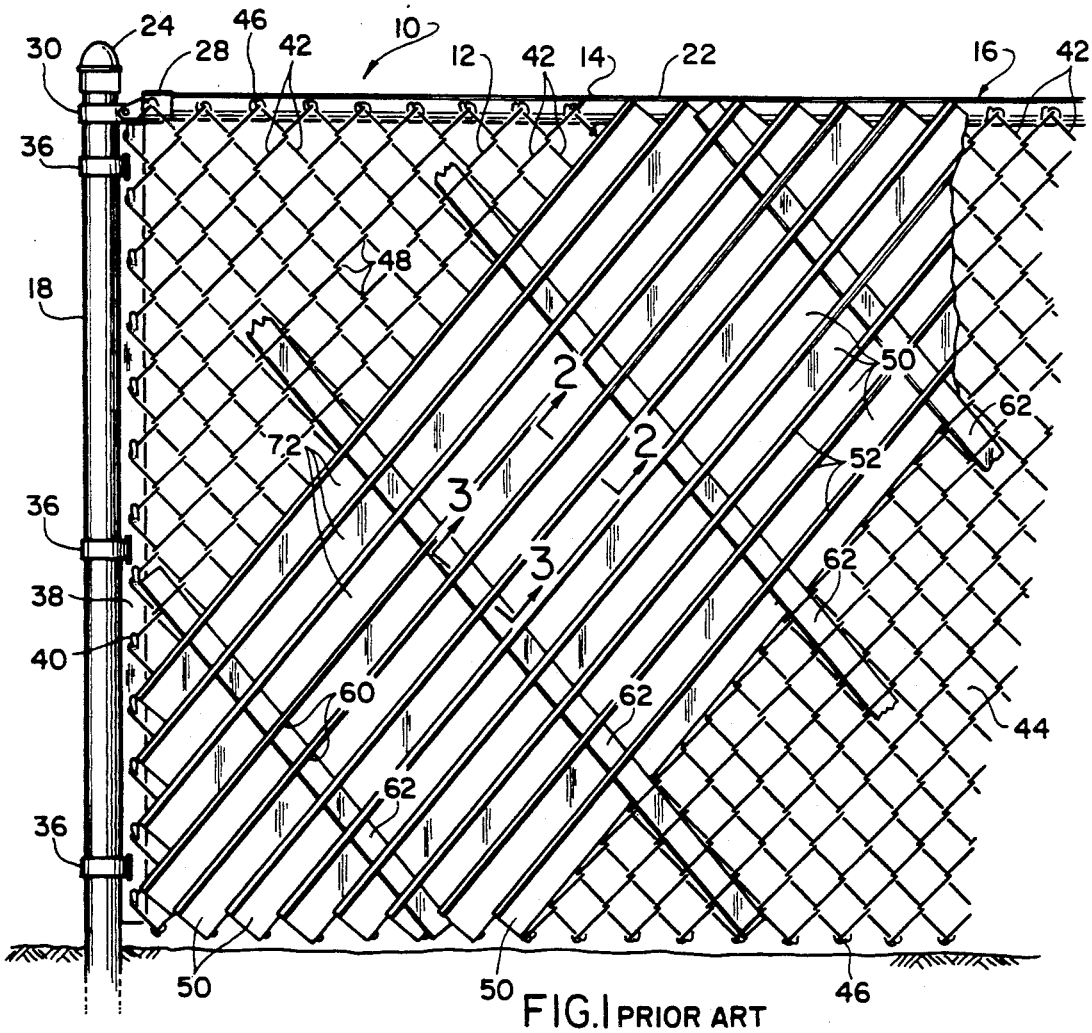
FIG.1 PRIOR ART
FIG. 1 is a front elevational view of a prior art chain link fence having slats interwoven therein according to the prior art.
Figure 5:
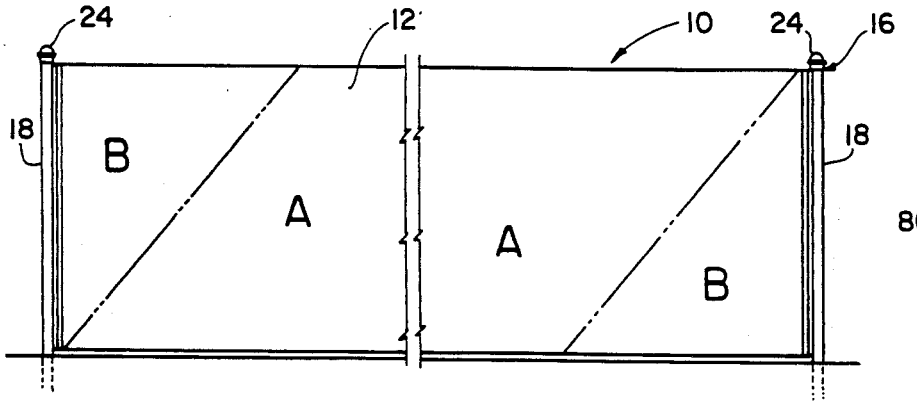
FIG. 5 is a schematic front elevational view of a conventional chain link fence.
Figure 10:
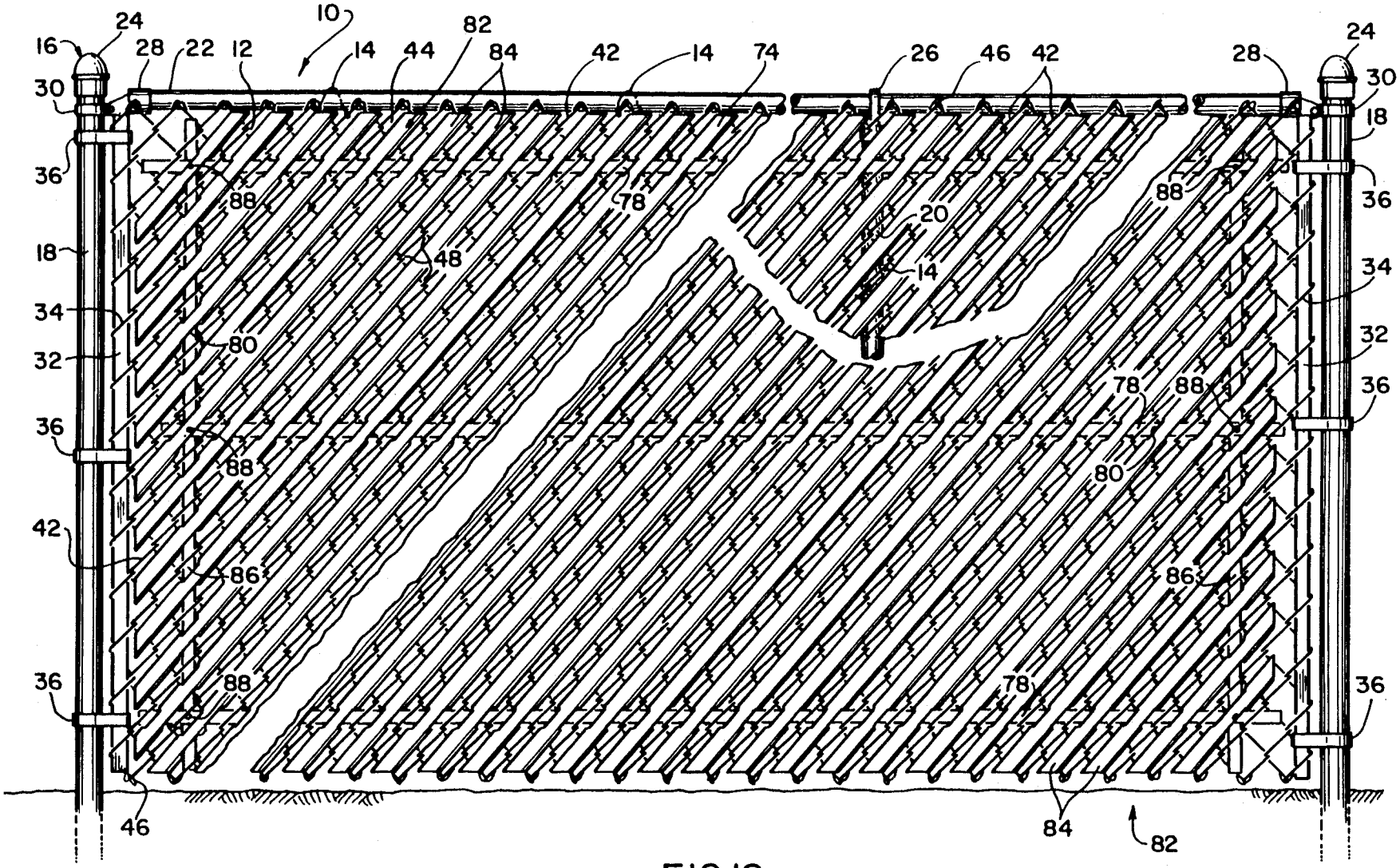
FIG. 10 is a front elevational view of the assembly of a chain link fence and slat retaining means according to the present invention.

It is already well known in the prior art and also part of the present invention to provide privacy and wind protection for a chain link fence using a system of interwoven plastic slat members, all as is shown in the assembly of chain link fence and slats of FIGS. 1, 5 and 10. Thus, prior art chain link fencing 10 of FIG. 1 is of known construction wherein, more particularly, it is comprised of 45 degree angled criss-crossing wire lengths forming a wire mesh fence body 12 which is suspended by tie wires 14 on a fence frame generally designated 16. Wire mesh 12 is typically supplied in a range 3 to 8 feet in height in combination with appropriate sized support posts that are usually implanted in the ground to a depth of 2 to 2½ feet, and are part of the frame 16.

As shown in FIG. 1, frame 16 consists principally of end or terminal posts 18, line posts 20 (FIG. 10) and top rail 22, all of which are sized according to manufacturer's recommendations. The top ends of terminal posts 18 are fitted with caps 24 while line posts 20 are topped with loop caps 26 (FIG. 10) which align and hold in position the top rail 22. Each opposite end of the top rail 22 is fitted with a cap 28 connected to a brace band 30, which is disposed in encircling relation about an end post 18.

Horizontal tension of the wire mesh 12 is maintained on a conventional chain link fence by inserting a tension bar 32 through each wire mesh end strand 34, as shown in FIG. 10. Bars 32 are then made fast to terminal posts 18 by standard tension bands 36. Additional tie wires 14 are used to secure the wire mesh 12 to line posts 20. In the prior art assembly of FIG. 1, a special tension bar 38 with hook elements 40 is utilized to anchor end strand 34.

Wire mesh 12, as best seen in FIG. 1, is manufactured by interlocking criss-crossing strands or lengths of wire 42 that may each be described as a "flattened sprial". The bounded space, as seen in front elevation, between wires 42 has the shape of plural vertically oriented diamonds 44 whose parallel sides each form an angle of 45 degrees with the horizontal. The upper and lower ends of the interengaged wires 42 are looped or twisted in pairs, as at 46. The interengaged or interlocking corners 48 of diamonds 44 automatically align in an approximately 45 degree diagonal pattern.

Figure 2:
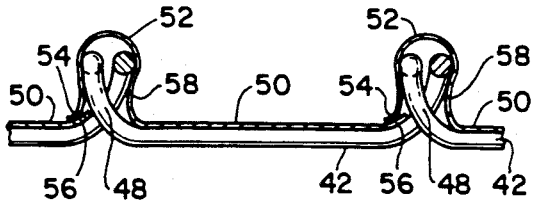
FIG.2 PRIOR ART
FIG. 2 is a cross sectional view taken along line 2—2 of FIG. 1.
Figure 3:
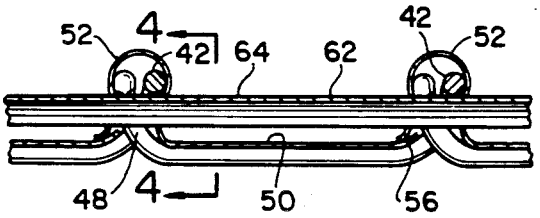
FIG.3 PRIOR ART
FIG. 3 is a cross sectional view taken along line 3—3 of FIG. 1.

In the prior are chain link fence and slat assembly of FIGS. 1, 2 and 3, slats 50, usually of sheet metal construction material, cover one side of the wire mesh or fabric 12, and each slat 50 is provided with a channel portion 52 which fits over a diagonally disposed row of interlocking wire corners 48.

Referring to FIG. 2, it will be noted that channel portion 52 runs along one edge 54 of slats 50 while the opposite edge 56 is slightly turned up and underlies the edge 54 of an adjacent slat 50. The channel portion 52 of each slot is provided with a resilient portion 58 designed to clip over interlocking corners 48.

Figure 4:
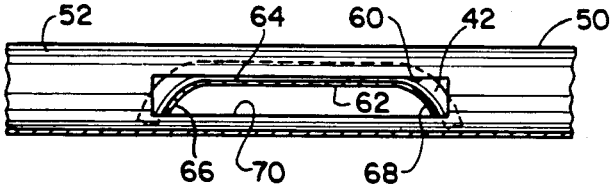
FIG.4 PRIOR ART
FIG. 4 is a cross sectional view taken along line 4—4 of FIG. 3.

Each channel portion 52 of each slat 50 is provided with spaced slots 60, in the opposite sides thereof, through which interlocking slots 62 are inserted. The slots 60 are spaced longitudinally in channel portion 52 to coincide with a uniform number of spaces between interlocking corners 48 for correspondingly providing uniform spacing of slats 62. As best seen in FIG. 4, slat 62 is provided with a convex side 64 which bears against the wires 42 of mesh 12, while opposite curved portions 66 and 68 bear against one side 70 of slot 60.

As schematically shown in FIG. 5, on any given rectangular fence 10, "full" slats 50 of uniform length are used in area A. The triangular areas B adjacent each terminal post 18 are "filled in" by on site cut or shop prepared progressively shorter slats 72.

Figure 7:
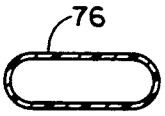
FIG. 7 is a cross sectional view taken along line 7—7 of FIG.
Figure 8:
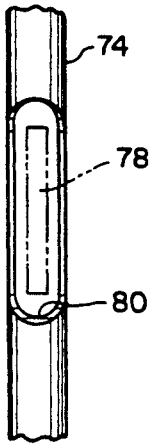
FIG. 8 is a view taken along lines 8—8 of FIG. 6, illustrating the interengagement of the vertically and forty-five degree angled slats of the present invention.
Figure 6:
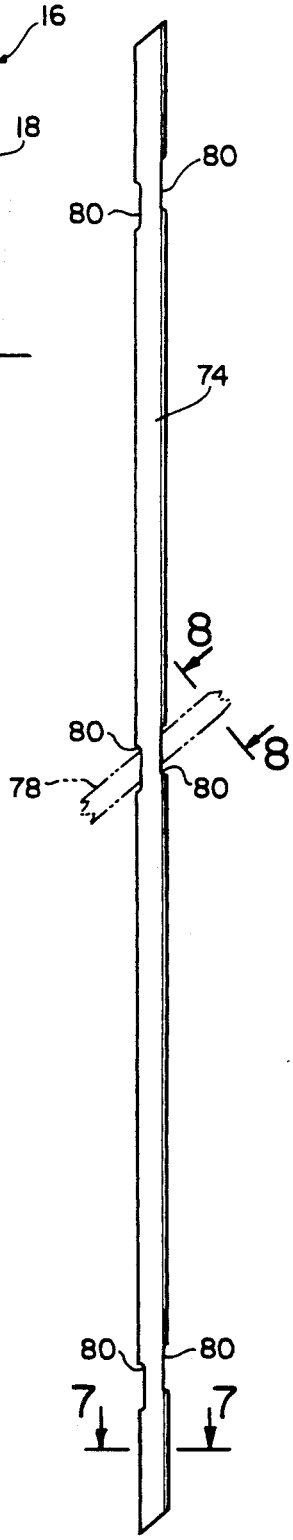
FIG. 6 is an isolated front elevational view of a diagonally disposed slat component 74 of the within invention which, in this figure is vertically displayed to minimize the display space allotted thereto to the marginal edge of the drawing sheet.

The chain link fence and slat assembly of the present invention, as shown in FIG. 10, utilizes plural first 45 degree diagonally oriented slats 74 (shown in vertical orientation in FIG. 6) to provide privacy and wind protection for a conventional chain link fence 10. Slats 74 are made of ultra-violet resistant polyethelene plastic as an extruded flattened tube 76, as best seen in FIG. 7. Tubing 76 is cut to a diagonal length compatible with the height of the wire mesh 12 to which it is interwoven.

Figure 9:
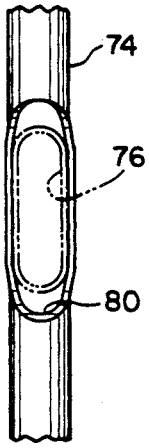
FIG. 9 is a view similar to FIG. 8 but illustrating a different shaped forty-five degree angled slat.

After installation, each slat 74 is held in place by one or more horizontally oriented retaining slats or strips 78 intertwined in the fence wires 42 and passed through aligned openings 80 in the opposite sides of the slats 74. The preferred type retaining slat or strip 78 is rectangular in cross section and measures 1⅛" by 0.050" in thickness. In the size noted, strip 78 has the advantage of being supplied on a supply spool and unwound therefrom for long length installation. Alternatively, lengths of flattened tubes 76 may, as shown in FIG. 9, be substituted for the flexible retaining strip 78.

Pairs of openings 80, provided on opposite edges of slats 74 to accommodate retaining strip 78 (or tubing 76), are provided at spaced intervals from each other to allow for convenient placement of the retaining means therethrough in the finished array. The number of retaining strips 78 and the vertical spacing thereof is a function of the size of the wire fabric and is generally between 18" to 30". For example, a nominal three foot fence would have two horizontal retaining strips, a four foot fence would have three strips, a six foot fence four strips and so on.

As in the prior art practice, (FIG. 5), the triangular areas B adjacent terminal posts 18 of fence 10 require progressively shorter slats made from tubing 76. In the present invention, a pair of "corner kits" 82 are supplied for each run of fence. Each kit 82 contains a suitable number of precut and notched slats 84. It is to be noted that the corner kit slats 84 are notched to receive a vertical retaining strip member 86. Slats 84 may also be prepared on site using tubing 76 and field tools. To provide a finished appearance, a sheet metal screw or through bolt 88 is typically used to tie retaining strips 78 and 86 in place.

Slats 74, 84 and retaining strips 78, 86 are manufactured in a variety of contrasting and compatible colors to provide decorative fence designs.

In contrast to the prior art practice as exemplified by the chain link fence and slat assembly of FIG. 1, in which the retaining strips 62 for the diagonal slats 72 are significantly more numerous in both the end areas B and in the main fence body area A, the within inventive strip or slat retaining means 78, 76 are few in number and are of uniform length, in that they are of a size equal to the length of the wire mesh body of the chain link fence. Underlying the present invention is the recognition that the four interconnections 48 of the criss-crossing wires 42 which bound the vertically oriented diamond shapes 44 also provide, in a horizontal perspective, a horizontally oriented channel above and below the two medial interconnections of each diamond shape. These horizontally oriented channels are used to advantage in accordance with the present invention to thus receive in a horizontal orientation the retaining means 78, 76 which, to be used as just noted, need only be and in practice are approximately in height ½ the vertical height of a wire mesh diamond shape, and in length are the length of the chain link fence.

While the chain link fence and slat retaining means for practicing the within invention assembly, as well as the method of assembling these components herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improved slat retaining means for a chain link fence comprising plural cooperating interwoven forty-five degree angled crossing wire lengths forming a wire mesh body for said fence, said body having intersections of said crossing wire lengths bounding vertical diamond shapes throughout and having opposed first and second vertical ends, plural first slats of plastic construction material each disposed in an operative position at a forty-five degree angle through said diamond shapes throughout the fence area between said vertical ends to contribute to privacy and wind protection, each of said first slats having spaced horizontally aligned apertures in opposite edges thereof and each of said first slats bordering one of said vertical ends having vertically aligned apertures in opposite edges thereof proximate the bordering vertical end, and first and second elongated flexible plastic strips of a height substantially of an extent equal to one-half the vertical height of a wire mesh diamond shape, said first strips having an operative position interwoven through said diamond shapes and through horizontally aligned apertures of said first slats, said second strips having an operative position interwoven through said diamond shapes and through vertically aligned apertures of said first slats, whereby said first slats are held in interwoven positions in said wire mesh fence by said first and second strips.

2. Improved slat retaining means for a chain link fence comprising plural cooperating interwoven forty-five degree angled crossing wire lengths forming a wire mesh body for said fence, said body having intersections of said crossing wire lengths bounding vertical diamond shapes throughout and having opposed first and second vertical ends, plural first slats of plastic construction material each disposed in an operative position at a forty-five degree angle through said diamond shapes throughout the fence area between said vertical ends to contribute to privacy and wind protection, each of said first slats having spaced horizontally aligned apertures in opposite edges thereof and each of said first slats bordering one of said vertical ends having vertically aligned apertures in opposite edges thereof proximate the bordering vertical end, and second and third elongated rectangular slats of a height substantially of an extent equal to one-half the vertical height of a wire mesh diamond shape, said second slats having an operative position interwoven through said diamond shapes and through horizontally aligned apertures of said first slats, said third slats having an operative position interwoven through said diamond shapes and through vertically aligned apertures of said first slats, whereby said first slats are held in interwoven positions in said wire mesh fence by said second and third slats.

3. The slat retaining means of claim 1 wherein said apertures have a pair of opposed parallel sides and said elongated flexible plastic strips are in the form of flattened tubes having a thickness slightly wider than the width of said apertures defined by said opposed parallel sides, said apertures being slightly deformed in the operative position by said strips to frictionally engage and embrace same.

* * * * *